US010968565B2

(12) United States Patent
Sick et al.

(10) Patent No.: US 10,968,565 B2
(45) Date of Patent: Apr. 6, 2021

(54) ARTIFICIAL TURF PRODUCTION USING A NUCLEATING AGENT

(71) Applicant: Polytex Sportbelage Produktions—GmbH, Grefrath (DE)

(72) Inventors: Stephan Sick, Willich-Neersen (DE); Dirk Sander, Kerken (DE); Bernd Jansen, Nettetal (DE); James Tritt, Pakenham (AU); Dirk Schmitz, Weeze (DE)

(73) Assignee: POLYTEX SPORTBELÄGE PRODUKTIONS GMBH, Grefrath (DE)

( * ) Notice: Subject to any disclaimer, the term of this patent is extended or adjusted under 35 U.S.C. 154(b) by 150 days.

(21) Appl. No.: 15/308,203

(22) PCT Filed: Apr. 16, 2015

(86) PCT No.: PCT/EP2015/058237
§ 371 (c)(1),
(2) Date: Nov. 1, 2016

(87) PCT Pub. No.: WO2015/165739
PCT Pub. Date: Nov. 5, 2015

(65) Prior Publication Data

US 2017/0051453 A1 Feb. 23, 2017

(30) Foreign Application Priority Data

May 2, 2014 (EP) ..... 14166854

(51) Int. Cl.
*E01C 13/08* (2006.01)
*D06N 7/00* (2006.01)
(Continued)

(52) U.S. Cl.
CPC ..... *D06N 7/0065* (2013.01); *D01D 5/0885* (2013.01); *D01D 5/12* (2013.01);
(Continued)

(58) Field of Classification Search
CPC .... E01C 13/08; D06N 7/0065; D06N 7/0073; D06N 7/0068; D06N 7/0071;
(Continued)

(56) References Cited

U.S. PATENT DOCUMENTS 3,414,646 A * 12/1968 Pitzl ..... D01D 11/00 264/210.5
3,550,369 A * 12/1970 Pitzl ..... D01F 6/60 428/400

(Continued)

FOREIGN PATENT DOCUMENTS

CN 101476174 A * 7/2009
CN 107574600 A * 1/2018

(Continued)

OTHER PUBLICATIONS

JP 2001-234443A translation from Google Patents, 2001.*

(Continued)

*Primary Examiner* — Cheryl Juska
(74) *Attorney, Agent, or Firm* — Harness, Dickey & Pierce, P.L.C.

(57) ABSTRACT

A method of manufacturing artificial turf includes the steps of: creating a polymer mixture including at least one polymer and a nucleating agent for crystallizing the at least one polymer, extruding the polymer mixture into a monofilament; quenching the monofilament; reheating the monofilament; stretching the reheated monofilament to form the monofilament into an artificial turf fiber, wherein during the stretching the nucleating agent boosts the creation of crystalline portions of the polymer within the monofilament;

(Continued)

incorporating the artificial turf fiber into an artificial turf backing, thereby mechanically fixing the monofilaments of the arranged artificial turf fibers in the artificial turf backing.

11 Claims, 5 Drawing Sheets

(51) Int. Cl.

| | |
|---|---|
| ***D01D 5/12*** | (2006.01) |
| ***D01F 1/04*** | (2006.01) |
| ***D01F 1/06*** | (2006.01) |
| ***D01F 1/10*** | (2006.01) |
| ***D01F 6/04*** | (2006.01) |
| ***D01D 5/088*** | (2006.01) |

(52) U.S. Cl.
CPC ..... *D01F 1/04* (2013.01); *D01F 1/06* (2013.01); *D01F 1/10* (2013.01); *D01F 6/04* (2013.01); *D06N 7/0068* (2013.01); *D06N 7/0073* (2013.01); *E01C 13/08* (2013.01); *D06N 7/0071* (2013.01); *D06N 2203/047* (2013.01); *D06N 2203/068* (2013.01); *D06N 2213/04* (2013.01); *D10B 2321/021* (2013.01); *D10B 2505/202* (2013.01); *Y10T 428/23979* (2015.04); *Y10T 428/23993* (2015.04)

(58) Field of Classification Search
CPC ..... D06N 2213/04; D01D 5/08; D01D 5/12; D01D 5/088; D01D 5/0885; D01F 1/10; D01F 6/04; D01F 6/06; D10B 2321/02; D10B 2321/021; D10B 2321/022; D10B 2505/202; Y10T 428/23993; Y10T 428/23979
See application file for complete search history.

(56) References Cited

U.S. PATENT DOCUMENTS

| | | | | |
|---|---|---|---|---|
| 5,587,118 | A * | 12/1996 | Mallonee | D01D 5/253 264/172.13 |
| 2003/0175475 | A1* | 9/2003 | Higgins | B32B 5/06 428/95 |
| 2005/0019565 | A1* | 1/2005 | Morin | D01F 6/60 428/364 |
| 2010/0040809 | A1* | 2/2010 | Muller | D01F 1/106 428/17 |
| 2010/0143687 | A1* | 6/2010 | Jacoby | C08F 110/06 428/220 |
| 2011/0143057 | A1* | 6/2011 | Leysen | C08L 23/10 428/17 |
| 2011/0196064 | A1* | 8/2011 | Volkel | D01D 10/02 523/200 |
| 2011/0250448 | A1* | 10/2011 | Jones | C08L 23/12 428/359 |
| 2012/0107527 | A1* | 5/2012 | Auffermann | C08J 5/18 428/17 |
| 2013/0030123 | A1* | 1/2013 | Martin | D01F 6/46 525/95 |
| 2014/0242304 | A1* | 8/2014 | Sandkuehler | C08F 210/16 428/17 |
| 2014/0243459 | A1* | 8/2014 | Mueller | D01F 1/106 524/100 |
| 2015/0152248 | A1* | 6/2015 | Kawamoto | C08K 5/0083 524/711 |
| 2015/0204027 | A1* | 7/2015 | Bonavoglia | E01C 13/08 428/17 |
| 2017/0058464 | A1* | 3/2017 | Smollett | D05C 17/02 |
| 2017/0096749 | A1* | 4/2017 | Mueller | D01F 1/106 |
| 2017/0121856 | A1* | 5/2017 | Sick | E01C 13/08 |
| 2017/0204536 | A1* | 7/2017 | Brunner | D01F 1/10 |
| 2017/0226333 | A1* | 8/2017 | Hsieh | C08L 25/14 |
| 2017/0265547 | A1* | 9/2017 | Sick | B05D 3/02 |
| 2018/0010304 | A1* | 1/2018 | Bonavoglia | E01C 13/08 |
| 2018/0058017 | A1* | 3/2018 | Schmitz | E01C 13/08 |
| 2019/0017206 | A1* | 1/2019 | Sick | D06N 7/0073 |
| 2019/0093291 | A1* | 3/2019 | Sick | C08G 18/7671 |

FOREIGN PATENT DOCUMENTS

| | | | | |
|---|---|---|---|---|
| JP | 56004712 | A * | 1/1981 | |
| JP | 09220781 | A * | 8/1997 | |
| JP | 11131319 | A * | 5/1999 | |
| JP | 2001234443 | A * | 8/2001 | |
| JP | 2003138441 | A * | 5/2003 | D02G 3/445 |
| JP | 2014080611 | A * | 5/2014 | |

OTHER PUBLICATIONS

JP 09-220781A translation (1997).*
JP 2001-234443A translation (2001).*
Chinese Office Action for corresponding Application No. 201510220071.7, dated May 29, 2020.
Chinese Office Action for corresponding Application No. 201510220071.7, dated May 31, 2019. English translation thereof.
Cited Reference from Chinese Examination Report dated May 31, 2019, English translation thereof.

* cited by examiner

ARTIFICIAL TURF PRODUCTION USING A NUCLEATING AGENT

CROSS-REFERENCE TO RELATED APPLICATION

This application claims priority under all applicable statutes, and is a U.S. National phase application (35 U.S.C. § 371) of International Application No. PCT/EP2015/058237, filed on Nov. 2, 2015, and entitled ARTIFICIAL TURF PRODUCTION USING A NUCLEATING AGENT, which claims priority to European Patent Application No. 14166854.1 filed on May 2, 2014, the contents of which are incorporated herein by reference in their entireties.

FIELD OF THE INVENTION

The invention relates to artificial turf and the production of artificial turf which is also referred to as synthetic turf. The invention further relates to the incorporation of artificial turf fibers into an artificial turf backing, and to a respective product and a production method for artificial turf.

BACKGROUND AND RELATED ART

Artificial turf or artificial grass is surface that is made up of fibers which is used to replace grass. The structure of the artificial turf is designed such that the artificial turf has an appearance which resembles grass. Typically artificial turf is used as a surface for sports such as soccer, American football, rugby, tennis, golf, for playing fields, or exercise fields. Furthermore artificial turf is frequently used for landscaping applications.

An advantage of using artificial turf is that it eliminates the need to care for a grass playing or landscaping surface, like regular mowing, scarifying, fertilizing and watering. Watering can be e.g. difficult due to regional restrictions for water usage. In other climatic zones the re-growing of grass and re-formation of a closed grass cover is slow compared to the damaging of the natural grass surface by playing and/or exercising on the field. Artificial turf fields though they do not require a similar attention and effort to be maintained, may require some maintenance such as having to be cleaned from dirt and debris and having to be brushed regularly. This may be done to help fibers stand-up after being stepped down during the play or exercise. Throughout the typical usage time of 5-15 years it may be beneficial if an artificial turf sports field can withstand high mechanical wear, can resist UV, can withstand thermal cycling or thermal ageing, can resist inter-actions with chemicals and various environmental conditions. It is therefore beneficial if the artificial turf has a long usable life, is durable, and keeps its playing and surface characteristics as well as appearance throughout its usage time.

In the European patent EP 1837423 a synthetic turf is described whose strands consist of polyethylene.

SUMMARY

The invention provides for a method of manufacturing artificial turf in the independent claims. Embodiments are given in the dependent claims. It is understood that one or more of the embodiments of the invention mentioned below may be combined as long as the combined embodiments are not mutually exclusive.

In one aspect, the invention relates to a method of manufacturing artificial turf. The method comprises the steps of:

creating a polymer mixture comprising at least one polymer and a nucleating agent for crystallizing the at least one polymer, the nucleating agent being an inorganic and/or an organic substance or a mixture thereof, wherein the inorganic nucleating agent consists of one of the following items or a mixture thereof:

talcum;

kaolin (also known as "china clay");

calcium carbonate;

magnesium carbonate;

silicate:

aluminium silicate and; as e.g. sodium aluminosilicate (in particular zeolithes of natural and synthetic origin);

amorphous and partially amorphous silica and mixed morphologies hereof, e.g. fumed silica;

silicic acid and silicic acid esters; e.g. tetraalkyl orthosilicate (also known as orthosilicic acid ester)

aluminium trihydrate;

magnesium hydroxide;

meta- and/or polyphosphates; and coal fly ash (CFA); coal fly ash is a fine recovered e.g. from coal-fires of electric generation power plants;

wherein the organic nucleating agent consists of one of the following items or a mixture thereof:

1,2-cyclohexane dicarbonic acid salts (also known as main component of "Hyperform®"); in particular calcium salts of the 1,2-cyclohexane dicarbonic acid;

benzoic acid;

benzoic acid salt; the benzoic acid salt may be, in particular, an alcaline metal salt of the benzoic acid (e.g. sodium and potassium salts of the benzoic acid); and an alkaline earth metal salt of the benzoic acid (e.g. magnesium and calcium salts of the benzoic acid);

sorbic acid; and sorbic acid salt. The sorbic acid salt may be, in particular, an alcaline metal salt of the sorbic acid (e.g. sodium and potassium salts of the sorbic acid); and an alkaline earth metal salt of the sorbic acid (e.g. magnesium and calcium salts of the sorbic acid);

extruding the polymer mixture into a monofilament; to perform this extrusion the polymer mixture may for instance be heated;

quenching the monofilament; in this step the monofilament may be cooled;

reheating the monofilament;

stretching the reheated monofilament to form the monofilament into an artificial turf fiber; during the stretching, the nucleating agent boosts the creation of crystalline portions of the at least one polymer within the monofilament; said boosting increases the surface roughness of the monofilament; and incorporating the artificial turf fiber into an artificial turf backing.

The incorporation is performed by:

arranging a plurality of the artificial turf fibers on a carrier, wherein first parts of the monofilaments of the arranged artificial turf fibers are exposed to a bottom side of the carrier and second parts of said monofilaments are exposed to a top side of the carrier;

adding a fluid on the bottom side of the carrier such that at least the first parts become embedded in the fluid; and causing the fluid to solidify into a film, the film surrounding and thereby mechanically fixing at least the first parts of the monofilaments of the arranged artificial turf fibers, the solid film acting as the artificial turf backing.

Said features may be advantageous as said method allows to strongly fix the artificial turf fiber within the backing, thereby providing an artificial turf that is more durable to mechanical stress, in particular in respect to mechanical pulling forces exerted on the fibers.

Said features may in particular allow to firmly attach several kinds of polyolefines used for artificial turf production, e.g. polyethylene (PE), to a backing of the artificial turf. Embodiments of the invention may lead to an increased life expectancy of artificial turf made from PE and similar polyolefines. Artificial turf and the fibers contained therein face a significant mechanical stress if used e.g. on a sports field. Fibers may become detached from the backing if, for example, a player abruptly stops or changes direction and thereby exerts a high pulling force on a fiber. The above described method of mechanically fixing turf fibers in the backing of artificial turf may result in the provision of a more durable kind of artificial turf which is specially suited for being used on a sports field.

In a further beneficial aspect, it has been observed that the fixing is based on mechanical forces, not on covalent bonds. The solidified fluid tightly surrounds and embeds protrusions and depressions of surface of the fiber. Said protrusions and depressions have been observed to be caused by the crystals. Thus, by adding the nucleating agent, the relative fraction of crystalline portions relative to amorphous portions of the at least one polymer may be increased, resulting in a rougher surface of the monofilaments and thus also in a rougher surface of the fibers and an increased mechanical grip exerted by the solidified fluid on the fiber. Fixing the fiber mechanically is advantageous, as it allows to firmly attach the fiber to any kind of backing material that can be applied as a fluid on the back side of the carrier and that solidifies after some time. Thus, fibers of a variety of different chemical compositions may be firmly embedded in a plurality of chemically divers backing materials. It is not necessary to prepare the fiber or the backing to be able to covalently bind to each other. This eases the manufacturing process and avoids the production of undesired byproducts. Thus, additional costs related to disposing chemical waste may be avoided and a broader combinatorial spectrum of fiber substances and backing substances that can be combined for creating artificial turf may be available.

Extruding the polymer mixture into a monofilament rather than a polymer film may be advantageous, because it has been observed that the process of cutting a film into slices to be used as artificial turf fibers destroys polymer crystals whose formation was caused by the nucleating agent in the stretching step. Thus, artificial turf fibers which are created by slicing an extruded and stretched polymer film will have a lower surface roughness than monofilaments which were stretched in a stretching operation.

In a further aspect, the invention relates to a further method of manufacturing artificial turf such that an artificial turf fiber of the artificial turf remains fixed in an artificial turf backing upon applying a predefined pulling force, the method comprising the steps of:

creating a polymer mixture comprising at least one polymer, a determined amount of a nucleating agent, and optionally one or more dyes;

wherein the nucleating agent is an inorganic and/or an organic substance or a mixture thereof; for example, the nucleating agent can be one or more of the above mentioned substances;

wherein the determined amount of the nucleating agent is the minimum amount of said nucleating agent necessary for providing a monofilament which is—after its extrusion, stretching and incorporation into an artificial turf backing in the form of an artificial turf fiber—capable of resisting the predefined pulling force;

wherein the determined amount of nucleating agent depends on the number and type of dyes contained in the polymer mixture, if any, and depends on the capability of each of said dyes to act as a nucleating agent;

extruding the polymer mixture into a monofilament;

quenching the monofilament;

reheating the monofilament;

stretching the reheated monofilament to form the monofilament into the artificial turf fiber;

incorporating the artificial turf fiber into the artificial turf backing by:

arranging a plurality of the artificial turf fibers on a carrier, wherein first parts of the monofilaments of the arranged artificial turf fibers are exposed to a bottom side of the carrier and second parts of said monofilaments are exposed to a top side of the carrier;

adding a fluid on the bottom side of the carrier such that at least the first parts become embedded in the fluid; and causing the fluid to solidify into a film, the film surrounding and thereby mechanically fixing at least the first parts of the monofilaments of the arranged artificial turf fibers, the solid film acting as the artificial turf backing.

Said features may be beneficial as they allow the creation of artificial turf whose surface roughness and corresponding ability to resist tuft withdrawal forces can be controlled and can be set to a desired value for a variety of different polymer mixtures, in particular for a large variety of polymer mixtures comprising different pigments and other dyes. According to a surprising observation, artificial turf fibers of a particular color were observed to show a higher resistance to tuft withdrawal forces than fibers having a different color. According to a further surprising observation, the increased resistance of fibers of some colors to tuft withdrawal forces is cased by nucleating capabilities of the respective dye, the dye having an impact on the number and size of crystalline portions and on the flexibility of an artificial turf fiber. Determining the amount of nucleating agent in dependence on the kind and amount of the dyes of the polymer mixture allow mixing turf fibers comprising different kinds of dyes in the same piece of artificial turf, whereby all turf fibers are manufactured such that they show the same resistance to tuft withdrawal forces and thus are equally resistant to wear and tear during the whole lifetime of the artificial turf. Thus, the lifetime of a piece of turf is not limited any more by the turf fiber comprising the pigment with the lowest capability of acting as a nucleating agent: according to embodiments, in case the one or more dyes in the polymer mixture are not able to trigger crystallization to a sufficient degree, an appropriate amount of nucleating agent may be added. Also, in case a polymer mixture already comprises a dye with sufficient nucleating capabilities, the amount of nucleating agent added to the polymer mixture may be reduced or may even be zero, thereby avoiding that the amount of polymer crystals exceeds the amount necessary for achieving the desired resistance to a tuft withdrawal force, also referred herein as "pulling force". This may reduce costs and may reduce the total amount of inorganic material in the fiber (a high fraction of inorganic material may reduce the flexibility of the fiber).

According to embodiments, the amount of nucleating agent is determined by performing a series of tests: a polymer mixture, referred herein as "desired polymer mixture", is created. The "desired polymer mixture" comprises all components of the polymer mixture to be used for creating the artificial turf fiber but does not yet comprise the nucleating agent whose amount shall be determined. Thus, said "desired polymer mixture" comprises the at least one polymer, zero, one or more dyes and zero, one or more additional additives. The "desired polymer mixture", is extruded, stretched and incorporated into a turf backing as described.

Preferentially, only a small amount of the "desired polymer mixture" is created and only a small piece of artificial turf is manufactured and used as a sample for testing. The predefined pulling force ("tuft withdrawal force") is then applied on an artificial turf fiber, e.g. in accordance with ISO/DES 4919:2011. If the artificial turf fiber remains fixed in the turf backing, adding of additional nucleating agents such as, for example, talcum or kaolin, can be omitted and the determined amount of the nucleating agent is zero. In case the artificial turf fiber is withdrawn by the determined pulling force, several additional polymer mixtures comprising the same composition of polymer, dyes and optional further additives as the "desired polymer mixture" are created. To each of said additional polymer mixtures, a growing amount of nucleating agent is added. For example, to additional polymer mixture APM1, 0.5% by weight of the polymer mixture is added. To additional polymer mixture APM2, 1% by weight of the polymer mixture is added. To additional polymer mixture APM3, 1.5% by weight of the polymer mixture is added. And so on, e.g. up to an amount of 3% by weight of the polymer mixture for inorganic nucleating agents or up to higher amounts, e.g. 8%, for organic nucleating agents. Each of said additional polymer mixtures is extruded, stretched and incorporated into the backing of a respective piece of artificial turf as described above. The one of the additional polymer mixtures comprising the minimum amount of nucleating agent that is sufficient for providing an artificial turf fiber that is not withdrawn from the artificial turf backing upon applying the determined pulling force is used as the determined amount of the nucleating agent. The determined amount of the nucleating agent is then added to the desired polymer mixture for manufacturing the artificial turf having the desired resistance to the predefined pulling force on a larger scale.

The features of the following embodiments can be combined with any one of the above methods for manufacturing artificial turf and with any kind of artificial turf disclosed herein if the features are not mutually exclusive.

According to preferred embodiments, the nucleating agent boosts, during the stretching, the creation of crystalline portions of the at least one polymer within the monofilament, wherein the boosting of the creation of the crystalline portions increases the surface roughness of the monofilament. Thus, also the surface of the monofilament will comprise polymer crystals which are created after the extrusion process and thus cannot be destroyed by mechanical forces acting on the polymer mixture during the extrusion process.

According to preferred embodiments, talcum and/or china clay is used. Preferably the talcum is used.

According to embodiments, if inorganic nucleating agents are used, the particle size of the nucleating agent is between 0.1 nanometer-50 micrometer, preferably between 0.1 nanometer-10 micrometer and still preferably 10 nanometer-5 micrometer.

According to some embodiments wherein an inorganic nucleating agent such as talcum is used as nucleating agent, 0.01-3 percentage by weight of the polymer mixture consists of the inorganic substance that is added to the polymer mixture for acting as the nucleating agent; Preferentially, 0.05-1 percentage by weight of the polymer mixture consists of said inorganic nucleating agent. Even more preferably 0.2-0.4 percentage by weight of the polymer mixture consists of said nucleating agent. Each part or fraction of the added inorganic substance may act the nucleating agent. Alternatively, at least fractions thereof act as the nucleating agent.

According to embodiments, at least a fraction of the total amount of the substance added for actually acting as the nucleating agent has a particle size smaller than 50 micrometer, preferably smaller than 10 micrometer and still preferably smaller than 5 micrometer.

The substance added for acting as the nucleating agent to the polymer mixture may be, for example, talcum.

According to preferred embodiments, the fraction of the inorganic nucleating agent that actually acts as the nucleating agent comprises at least 20% by weight of the talcum, more preferentially said fraction comprises at least 70% by weight of the talcum and more preferentially said fraction comprises at least 90% by weight of the talcum. Thus, for example, at least 20% of the talcum added to the polymer mixture must be smaller than 50 micrometer, preferably smaller than 10 micrometer and still preferably smaller than 5 micrometer.

According to embodiments, the at least one polymer comprises crystalline portions and amorphous portions, wherein the presence of the nucleating agent in the polymer mixture during the stretching causes an increase in the size of the crystalline portions relative to the amorphous portions. This may lead for instance to the at least one polymer to become more rigid than when it has an amorphous structure. This may lead to an artificial turf with more rigidity and ability to spring back when pressed down. The stretching of the monofilament may cause the at least one polymer to have a larger portion of its structure become more crystalline. Stretching the at least one polymer will cause an even further increase in the crystalline regions in the presence of a nucleating agent.

According to embodiments, the polymer mixture comprises less than 20 percentage by weight of inorganic material in total, wherein the inorganic material may comprise inorganic fractions of the chemically inert filler material and/or inorganic dyes (e.g. $TiO_2$) and/or the inorganic nucleating agent. Preferentially, the polymer mixture comprises less than 15 percentage by weight of said inorganic material in total. Even more preferentially, the polymer mixture comprises less than 105 percentage by weight of said inorganic material in total.

This may be advantageous as it is ensured that the tensile strength of the turf filament created from the polymer mixture is not significantly decreased by a growing fraction of crystalline portions in the filament.

According to embodiments, the fluid added on the bottom side of the carrier is a suspension comprising at least 20 percent by weight styrene-butadiene, at least 40% of chemically inert filler material, and at least 15% dispersion fluid. The solidification of the fluid into the film comprises drying the suspension, e.g. by applying heat and/or air flow. Said film consisting of a solidified styrene-butadiene suspension is also known as latex film.

According to embodiments, the suspension comprises 22-28 percent by weight of the styrene-butadiene, 50-55 percent by weight of the filler material, and at least 20% of water acting as the dispersion fluid. Preferably, the suspension comprises 24-26% by weight styrene-butadiene.

According to other embodiments, the fluid is a mixture of polyols and polyisocyanates. Polyols, as used herein, are compounds with multiple hydroxyl functional groups available for organic reactions. The solidification of the fluid into the film comprises executing a polyaddition-reaction of the polyols and the polyisocyanates for generating polyurethane. The solid film is a polyurethane film.

According to embodiments, the fluid comprises one or more of the following compounds: antimicrobial additives, fungicides, odor-emitting substances, a UV stabilizer, a flame retardant, an anti-oxidant, a pigment.

In some examples the stretched monofilament may be used directly as the artificial turf fiber. For example the monofilament could be extruded as a tape or other shape. In other examples the artificial turf fiber may be a bundle or group of several stretched monofilament fibers is in general cabled, twisted, or bundled together. The method may further comprise weaving, bundling, or spinning multiple monofilaments together to create the artificial turf fiber. Multiple, for example 4 to 8 monofilaments, could be formed or finished into a yarn. In some cases the bundle is rewound with a so called rewinding yarn, which keeps the yarn bundle together and makes it ready for the later tufting or weaving process. The monofilaments may for instance have a diameter of 50-600 micrometer in size. The yarn weight may typically reach 50-3000 dtex.

In another embodiment creating the artificial turf fiber comprises weaving the monofilament into the artificial turf fiber. That is to say in some examples the artificial turf fiber is not a single monofilament but a combination of a number of fibers. In another embodiment the artificial turf fiber is a yarn. In another embodiment the method further comprises bundling stretched monofilaments together to create the artificial turf fiber.

According to embodiments the method further comprises determining an amount of the nucleating agent such that said amount of the nucleating agent is capable of boosting the creation of crystalline portions such that the crystallization is slow enough to ensure that the majority of crystalline portions is created during the stretching (and thus, not before the stretching) and is sufficient to boost the creation of sufficiently many crystalline portions to ensure that the surface roughness is high enough that the embedded artificial turf fiber remains fixed in the artificial turf backing unless a pulling force over 30 Newton, more preferentially over 40 Newton, more preferentially over 50 Newton, is applied on the fiber. The adding of the nucleating agent comprises adding the determined amount of the nucleating agent.

According to embodiments, the determination if the embedded artificial turf fiber remains fixed in the artificial turf backing unless a pulling force over one of the above specified thresholds is applied on the fiber is executed in accordance with a test for measuring a tuft withdrawal force as specified in ISO/DES 4919:2011.

According to embodiments, a substance being capable of acting as a nucleating agent is a substance that, if added to the polymer mixture, is capable of increasing the frictional forces which fix the artificial turf fiber in the artificial turf backing by 10 Newton in accordance with a test for measuring a tuft withdrawal force as specified in ISO/DES 4919:2011. Preferentially, this effect is achieved without significantly increasing the brittleness of the material of the artificial turf fiber to be created from the polymer mixture. Preferentially, a substance being capable of acting as a nucleating agent is a substance that, if added to the polymer mixture in an amount that less than 3 percentage by weight of the polymer mixture consists of the added nucleating agent, is capable of increasing the frictional forces which fix the artificial turf fiber in the artificial turf backing by 10 Newton in accordance with a test for measuring a tuft withdrawal force as specified in ISO/DES 4919:2011.

According to embodiments, a substance being capable of acting as a dye is a substance that causes the artificial turf fiber to be created from the polymer mixture to emit a predefined spectrum of visible light. For example, a spectrophotometer and/or a colorimeter may be used to test if the dye causes the generated fiber to emit a predefined spectral pattern, e.g. a spectral pattern that is perceived by the human eye as "green", "white", "blue" or any other color. The color may be specified by means of the CMYK color code, the RAL color code, the Pantone color code or any other standard to test if a measured emission spectrum reflects a desired spectral pattern.

According to embodiments, the predefined spectrum of visible light caused by the dye differs from the spectrum of visible light emitted from the same type of artificial turf fiber lacking said dye.

According to embodiments, the method further comprises:

adding a first amount of a first dye to the polymer mixture, the first amount of the first dye being incapable of boosting the creation of the crystalline portions; the first amount of the first dye may be completely incapable of boosting the creation of any polymer crystal or may be incapable of boosting the creation of a predefined, desired amount of crystalline portions in the extruded and stretched monofilament; the first dye may be capable of boosting the creation of the crystalline portions if added to the polymer mixture in a higher concentration, but not in the given, first amount, which cannot be changed or increased as this would have an impact on the color of the fibers; the color of the artificial turf to be manufactured is, however, considered as given and should not be changed;

determining a second amount of the nucleating agent, wherein the second amount is determined such that the first amount of the first dye in combination with the second amount of the nucleating agent are capable of boosting the creation of crystalline portions such that the crystallization is slow enough to ensure that the majority of crystalline portions is created during the stretching and is sufficient to boost the creation of sufficiently many crystalline portions to ensure that the surface roughness is high enough that a bundle of six embedded artificial turf fibers remains fixed in the artificial turf backing unless a pulling force over 30 Newton more preferentially over 40 Newton, more preferentially over 50 Newton, is applied on the fiber.

The adding of the nucleating agent comprises adding the determined second amount of the nucleating agent.

Said features may be advantageous as they allow reducing the amount of nucleating agent in case the used dye already has some (measurable but insufficient) capability to boost the crystallization of the at least one polymer. Also, in case two dyes of the same color are available, the method may comprise choosing the one out of said two dyes having the higher capability to act as nucleating agent and to boost the crystallization of the at least one polymer. This may also improve the fixing of the fibers into the backing and may help to reduce the amount of nucleating agent necessary.

Choosing the amount and type of the nucleating agent such that the majority of crystals is formed in the stretching process (rather than in the extrusion process) may be advantageous as this crystals which are created before or during the extrusion process may be destroyed by the shear forces that are generated at the surface of a nascent monofilament when the polymer mixture is pressed through said openings. Thus, the surface roughness achieved by a given amount of nucleating agent can be maximized.

According to embodiments, the total amount of inorganic material in the polymer mixture is below 20% by weight, more preferentially below 15% by weight and even more preferentially below 10% by weight. Minimizing the amount of nucleating agent, in particular minimizing the amount of inorganic nucleating agent, may allow achieving a desired degree of surface roughness and resistance to the pulling force without the fibers becoming become brittle due to an interruption of Van-der-Waals forces between the polymers by the inorganic material and/or by a too large number of crystalline portions.

In a further advantageous aspect, using a dye that is also capable of acting as nucleating agent may allow to ensure that the total amount of inorganic material in the polymer mixture is below 20% by weight, more preferentially below 15% by weight and even more preferentially below 10% by weight. This will ensure that the fiber does not become brittle if the Van-der-Waals forces between the polymers are weakened by the inorganic material and/or by a too large number of crystalline portions.

According to embodiments the method further comprises adding Titanium-Dioxide to the polymer mixture. Titanium-Dioxide may allow to create lighter fiber colors or fibers having a white tone. The Titanium-Dioxide acts as a dye. The polymer mixture comprises 1.9-2.3 (preferably 2.1) percentage by weight of the Titanium-Dioxide after said adding.

According to embodiments the method further comprises adding an azo-nickel-complex pigment to the polymer mixture. The azo-nickel-complex pigment acts as a dye. The polymer mixture comprises 0.01-0.5 (preferably between 0.1-0.3) percentage by weight of the azo-nickel-complex pigment after said adding.

According to embodiments phthalocyanine metal complexes like e.g. phthalocyanine copper complexes may be used as substances acting as a dye and as a nucleating agent.

According to first group of embodiments the method further comprises adding phthalocyanine green to the polymer mixture. The phthalocyanine green acts as a dye. The polymer mixture comprises 0.001-0.3 (preferably 0.05-0.2) percentage by weight of the phthalocyanine green after said adding.

According to a second group of embodiments the method further comprises adding phthalocyanine blue to the polymer mixture, phthalocyanine blue acts as a dye. The polymer mixture comprises 0.001-0.25 (preferably 0.15-0.20) percentage by weight after said adding.

The method of any one of the previous claims, wherein some or all parts of the surface of the artificial turf fiber embedded in the fluid are wetted by the fluid. According to embodiments the at least one polymer is a non-polar polymer.

Applying the above described method on non-polar polymers is particularly advantageous as non-polar polymers tend to be hydrophobic. This is known to impede the wettening by hydrophilic fluids such as the above mentioned suspension for creating a latex film. It has been observed that the adding of the nucleating agent results in an increased surface roughness of the filament due to an increased fraction of crystalline portions within the filament and also results in an increased wettening of the fiber surface by the applied fluid used for embedding at least the first parts of the fibers. The increased surface roughness of the fiber provides for a synergistic effect with the increased wettening effect: the eased wettening of the fiber surface allows the fluid to penetrate also tight, deep depressions and recesses of the surface of the fiber. This results in a strong mechanical fixing of the fiber in the solidified fluid.

According to embodiments the at least one polymer is polyethylene, polypropylene, or a mixture thereof. Preferentially, the at least one polymer is polyethylene. The kind of olefin used for creating the artificial turf fiber has a significant impact on various properties of the fiber and the artificial turf made from said fiber. Polyamides (PA), for example, are known for their good bend recovery. However, their surface is known to cause skin burns when used as ground of a sports field, and the life expectancy of a PA-based artificial turf is limited if extensively exposed to UV radiation of direct sunlight. Polypropylene has similar disadvantages. Polyethylene (PE) does not show said disadvantages but has the disadvantage that it cannot be fixed firmly to a backing by mechanical forces due to its hydrophobic surface and increased softness compared to PA/PP. Thus, embodiments of the invention may allow using PE for manufacturing the artificial turf and may allow to firmly and mechanically attach PE fibers to the artificial turf backing.

According to embodiments the polymer mixture comprises 80 to 90 percent by weight the at least one polymer.

According to embodiments, creating the artificial turf fiber comprises forming the stretched monofilament into a yarn.

According to embodiments, creating the artificial turf fiber comprises weaving, spinning, twisting, rewinding, and/or bundling the stretched monofilament into the artificial turf fiber.

According to embodiments, incorporating the artificial turf fiber into the artificial turf backing comprises: tufting the artificial turf fiber into the artificial turf backing and binding the artificial turf fibers to the artificial turf backing. For instance the artificial turf fiber may be inserted with a needle into the backing and tufted the way a carpet may be. If loops of the artificial turf fiber are formed then the loops may be cut during the same step.

According to embodiments, incorporating the artificial turf fiber into the artificial turf backing comprises weaving the artificial turf fiber into the artificial turf backing. This technique of manufacturing artificial turf is known from United States patent application US 20120125474 A1. By using a weaving technique, it is possible to obtain a semi-random pattern in the carrier which may give the artificial turf a natural appearance. Furthermore, weaving is a simpler technique than tufting as the cutting of the fibers after their insertion into the carrier is omitted. In tufting, the fiber is woven into the carrier first, and subsequently loops the fibers at one side of the carrier are cut. After having woven the fiber into the carrier, the fluid is applied on the bottom side of the carrier as described above.

According to embodiments the carrier is a textile or a textile matt. A textile may be a flexible woven material consisting of a network of natural or artificial fibers often referred to as thread or yarn. Textiles are formed by weaving, knitting, crocheting, knotting, or pressing fibers together.

In another embodiment the polymer mixture further comprises any one of the following: a wax, a dulling agent, a ultraviolet stabilizer, a flame retardant, an anti-oxidant, a pigment, and combinations thereof. These listed additional components may be added to the polymer mixture to give the artificial turf fibers other desired properties such as being flame retardant, having a green color so that the artificial turf more closely resembles grass and greater stability in sunlight.

The melt temperature used during extrusions is dependent upon the type of polymers and compatibilizer that is used. However the melt temperature is typically between 230° C. and 280° C.

A monofilament, which can also be referred to as a filament or fibrillated tape, is produced by feeding the mixture into an fiber producing extrusion line. The melt mixture is passing the extrusion tool, i.e., a spinneret plate or a wide slot nozzle, forming the melt flow into a filament or tape form, is quenched or cooled in a water spin bath, dried and stretched by passing rotating heated godets with different rotational speed and/or a heating oven.

The monofilament or type is then annealed online in a second step passing a further heating oven and/or set of heated godets.

According to embodiments, the polymer mixture is at least a three-phase system. The polymer mixture comprises a first polymer and the at least one polymer referred to in the following as 'second polymer'. The first polymer and the second polymer are immiscible.

The first polymer may consist of, for example, a polar substance, such as polyamide. The first polymer could also be polyethylene terephthalate which is commonly known by the abbreviation PET.

The second polymer can be a non-polar polymer, such as polyethylene. In another embodiment the second polymer is polybutylene terephthalate which is also known by the common abbreviation PBT or polypropylene (PP).

The polymer mixture may further comprise a compatibilizer. The compatibilizer may be any one of the following: a maleic acid grafted on polyethylene or polyamide; a maleic anhydride grafted on free radical initiated graft copolymer of polyethylene, SEBS, EVA, EPD, or polyproplene with an unsaturated acid or its anhydride such as maleic acid, glycidyl methacrylate, ricinoloxazoline maleinate; a graft copolymer of SEBS with glycidyl methacrylate, a graft copolymer of EVA with mercaptoacetic acid and maleic anhydride; a graft copolymer of EPDM with maleic anhydride; a graft copolymer of polypropylene with maleic anhydride; a polyolefin-graft-polyamidepolyethylene or polyamide; and a polyacrylic acid type compatibilizer.

The first polymer forms polymer beads surrounded by the compatibilizer within the second polymer. The term 'polymer bead' or 'beads' may refer to a localized region, such as a droplet, of a polymer that is immiscible in the second polymer. The polymer beads may in some instances be round or spherical or oval-shaped, but they may also be irregularly-shaped. In some instances the polymer bead will typically have a size of approximately 0.1 to 3 micrometer, preferably 1 to 2 micrometer in diameter. In other examples the polymer beads will be larger. They may for instance have a size with a diameter of a maximum of 50 micrometer.

The adding of the first dye or of the substance is executed before the extruding. The stretching results in a deformation of the polymer beads into threadlike regions. This causes the monofilament to become longer and in the process the polymer beads are stretched and elongated. Depending upon the amount of stretching the polymer beads are elongated more.

The thread-like regions may have a diameter of less than 20 micrometer, e.g. less than 10 micrometer. In another embodiment the thread-like regions have a diameter of between 1 and 3 micrometer. In another embodiment the artificial turf fiber extends a predetermined length beyond the artificial turf backing. The thread-like regions have a length less than one half of the predetermined length, e.g. a length of less than 2 mm.

Embodiments may have the advantage that the second polymer and any immiscible polymers may not delaminate from each other. The thread-like regions are embedded within the second polymer. It is therefore impossible for them to delaminate. The use of the first polymer and the second polymer enables the properties of the artificial turf fiber to be tailored. For instance a softer plastic may be used for the second polymer to give the artificial turf a more natural grass-like and softer feel. A more rigid plastic may be used for the first polymer or other immiscible polymers to give the artificial turf more resilience and stability and the ability to spring back after being stepped or pressed down. A further advantage may possibly be that the thread-like regions are concentrated in a central region of the monofilament during the extrusion process. This leads to a concentration of the more rigid material in the center of the monofilament and a larger amount of softer plastic on the exterior or outer region of the monofilament. This may further lead to an artificial turf fiber with more grass-like properties. A further advantage may be that the artificial turf fibers have improved long term elasticity. This may require reduced maintenance of the artificial turf and require less brushing of the fibers because they more naturally regain their shape and stand up after use or being trampled.

In another embodiment the polymer mixture comprises between 5% and 10% by weight of the first polymer. This example may have the balance of the weight made up by the second polymer, the compatibilizer, and any other additional additives mixed into the polymer mixture.

In another embodiment the creating of the polymer mixture comprises the step of forming a first mixture by mixing the first polymer with the compatibilizer. The creation of the polymer mixture further comprises the step of heating the first mixture. The step of creating the polymer mixture further comprises the step of extruding the first mixture. The creation of the polymer mixture further comprises the steps of granulating the extruded first mixture. The creating of the polymer mixture further comprises the step of mixing the granulated first mixture with the second polymer, the nucleating agent and optionally additives and/or dyes. The creation of the polymer mixture further comprises the step of heating the granulated first mixture with the second polymer to form the polymer mixture. This particular method of creating the polymer mixture may be advantageous because it enables very precise control over how the first polymer and compatibilizer are distributed within the second polymer. For instance the size or shape of the extruded first mixture may determine the size of the polymer beads in the polymer mixture. In the aforementioned method of creating the polymer mixture for instance a so called one-screw extrusion method may be used.

As an alternative to this the polymer mixture may also be created by putting all of the components that make it up together at once. For instance the first polymer, the second polymer, the nucleating agent and the compatibilizer could be all added together at the same time. Other ingredients such as additional polymers or other additives and dyes could also be put together at the same time. The amount of mixing of the polymer mixture could then be increased for instance by using a two screw feed for the extrusion. In this case the desired distribution of the polymer beads can be achieved by using the proper rate or amount of mixing.

In a first step, the first polymer may be mixed with the compatibilizer. Color pigments, UV and thermal stabilizers, process aids and other substances that are as such known from the art can be added to the mixture. This may result in granular material which consist of a two phase system in which the first polymer is surrounded by the compatibilizer. In a second step, a three-phase system is formed by adding the second polymer to the mixture whereby in this example the quantity of the second polymer is about 80-90 mass percent of the three-phase system, the quantities of the first polymer being 5% to 10% by mass and of the compatibilizer being 5% to 10% by mass. Using extrusion technology results in a mixture of droplets or of beads of the first polymer surrounded by the compatibilizer that is dispersed in the polymer matrix of the second polymer. In a practical implementation a so called master batch including granulate of the first polymer and the compatibilizer is formed. The master batch may also be referred to as a "polymer mixture" herein. The granulate mix is melted and a mixture of the first polymer and the compatibilizer is formed by extrusion. The resulting strands are crushed into granulate. The resultant granulate and granulate of the second polymer are then used in a second extrusion to produce the thick fiber which is then stretched into the final fiber.

The extrusion is executed as described above. By this procedure the beads or droplets of polymer 1, surrounded by the compatibilizer are stretched into longitudinal direction and form small fiber like, linear structures which stay however completely embedded into the polymer matrix of the second polymer.

According to some embodiments of the further method of manufacturing artificial turf, the predetermined pulling force is 30 Newton, more preferentially 40 Newton, more preferentially 50 Newton.

According to some embodiments of the further method of manufacturing artificial turf, the determined amount of the nucleating agent is determined such that said amount of the nucleating agent is capable of boosting the creation of crystalline portions such that the crystallization is slow enough to ensure that the majority of crystalline portions is created during the stretching and is sufficient to boost the creation of sufficiently many crystalline portions to ensure that the surface roughness is high enough that the embedded artificial turf fiber remains fixed in the artificial turf backing unless the predefined pulling force is applied.

For example, this may be determined by executing a series of tests as described above.

According to embodiments, the polymer mixture comprises 1.9-2.3 percentage by weight Titanium-Dioxide, the Titanium-Dioxide acting as a dye. Alternatively, the polymer mixture comprises 0.01-0.5 percentage by weight an azo-nickel-complex pigment, the azo-nickel-complex pigment acting as a dye. In each of said two cases, the determined amount of the nucleating agent for said polymer mixture is identical to an amount of the nucleating agent determined for polymer mixtures not comprising any dye. The amount of nucleating agent necessary depends on the determined pulling force and the type of nucleating agent used. For example, the nucleating agent is an inorganic substance, and the determined amount of the nucleating agent is 0.01-3 percentage by weight of the polymer mixture. For example, the determined pulling force may be 30 Newton, more preferentially 40 Newton, more preferentially 50 Newton and a fiber created from said polymer mixture will be capable of resisting any of said pulling forces.

According to other embodiments, the polymer mixture comprises 0.001-0.3 percentage by weight of phthalocyanine green, the phthalocyanine green acting as a dye. Alternatively, the polymer mixture comprises 0.001-0.25 percentage by weight of phthalocyanine blue, the phthalocyanine blue acting as a dye. In each of said two cases, the determined amount of the nucleating agent for said polymer mixture is zero. For example, the determined pulling force may be 30 Newton, more preferentially 40 Newton, more preferentially 50 Newton and a fiber created from said polymer mixture will be capable of resisting any of said pulling forces. No additional nucleating agent may be necessary as phthalocyanine green and phthalocyanine blue are capable of acting as a nucleating agent.

According to some embodiments of the further method of manufacturing artificial turf, the method comprises creating a first artificial turf fiber from the above mentioned polymer mixture comprising the Titanium-Dioxide or the azo-nickel-complex pigment. The method further comprises creating a second artificial turf fiber from the above mentioned polymer mixture comprising the phthalocyanine green or phthalocyanine blue dye. Both the first and the second artificial turf fiber are incorporated in the same piece of artificial turf. This may be beneficial as e.g. white fibers comprising Titanium-Dioxide show the same resistance against the determined pulling force as green fibers (comprising phthalocyanine blue dye).

In a further aspect, the invention relates to an artificial turf manufactured according to the method of any one of the above mentioned embodiments.

In a further aspect, the invention relates to an artificial turf comprising an artificial turf backing and artificial turf fiber incorporated into the artificial turf backing. The artificial turf fiber comprises at least one monofilament. Each of the at least one monofilament comprises at least one polymer and a nucleating agent for crystallizing the at least one polymer. The nucleating agent is one of the organic or inorganic substances mentioned above.

The artificial turf fiber and a plurality of further artificial turf fibers are arranged together in a carrier. The carrier lies on a surface of or within the artificial turf backing. The fibers are arranged in a way that first parts of the monofilaments of the arranged artificial turf fibers are exposed to a bottom side of the carrier and second parts of said monofilaments are exposed to a top side of the carrier. At least the first parts are embedded in and mechanically fixed by a solid film. The solid film is a solidified fluid. The solid film acts as the artificial turf backing.

In a further aspect the invention relates to an artificial turf comprising an artificial turf backing and an artificial turf fiber incorporated into the artificial turf backing. The artificial turf fiber comprises at least one monofilament.

Each of the at least one monofilament comprises: at least one polymer; a first substance incapable of acting as a dye and capable of acting as a nucleating agent for crystallizing the at least one polymer; and a second substance capable of acting as a dye and incapable of acting as a nucleating agent for crystallizing the at least one polymer.

A plurality of the artificial turf fibers are arranged in a carrier in a way that first parts of the monofilaments of the arranged artificial turf fibers are exposed to a bottom side of the carrier and second parts of said monofilaments are exposed to a top side of the carrier. At least the first parts are embedded in and mechanically fixed by a solid film. The solid film is a solidified fluid. The solid film acts as the artificial turf backing.

According to embodiments, the artificial turf backing further incorporates a further artificial turf fiber. The further artificial turf fiber comprises at least a further monofilament. The further monofilament comprises at least one further polymer and a third substance. The at least one further polymer is chemically identical to the above mentioned at least one polymer or is chemically different from the above mentioned at least one polymer (e.g. PP instead of PE, or a PE variant having different kind of side group or side groups). The third substance is capable of acting as a nucleating agent for crystallizing the at least one further polymer and is in addition capable of acting as a dye. A plurality of the further artificial turf fibers are also arranged in the carrier in a way that first parts of the further monofilaments of the arranged further artificial turf fibers are exposed to the bottom side of the carrier and second parts of said further monofilaments are exposed to the top side of the carrier. At least the first parts of said further monofilaments also are embedded in and mechanically fixed by the solid film.

According to embodiments, the further monofilament lacks the first substance and lacks any further nucleating agent. Thus, the third substance may be the only nucleating agent contained in the further monofilament. This may be advantageous, because in case a desired tuft withdrawal force is achieved by the nucleating capabilities of a used dye alone, adding additional nucleating agents might reduce the flexibility of the fiber by an increased amount of crystalline polymer portions.

According to embodiments, the type and amount of the second substance is chosen such that the resistance of the at least one monofilament to a predefined tuft withdrawal force is identical to the resistance of the further monofilament to said predefined tuft withdrawal force. The resistance of a monofilament to an applied tuft withdrawal force can be determined, for example, with the above mentioned test for measuring a tuft withdrawal force specified in ISO/DES 4919:2011. This may allow manufacturing an artificial turf comprising a mixture of fibers of different colors which—despite different nucleating capabilities of the respective dyes—all have the same surface roughness and show the same resistance to a given tuft withdrawal force.

According to embodiments, the at least one monofilament and also the further monofilament have been created by the extrusion and stretching process as described above.

According to embodiments, the third substance is phthalocyanine green or phthalocyanine blue or a mixture thereof.

According to embodiments, the first substance is Titanium-Dioxide or azo nickel-complex pigment or a mixture thereof.

According to embodiments, the second substance is one of the above mentioned organic and/or inorganic nucleating agents such as sorbic acid or talcum.

According to embodiments, the first substance is Titanium-Dioxide which may be used as a dye providing white color. The plurality of the artificial turf fibers comprising the first substance are positioned within the artificial turf backing such that one or more continuous lines solely comprising artificial turf fibers comprising the first substance are formed. Each of said lines has a width of at least 1 centimeter and a length of at least 1 meter. Each of said lines are surrounded by areas of the artificial turf which selectively comprise other artificial turf fibers. The other artificial turf fibers comprise a different dye or no dye at all. Said features may be advantageous as an artificial turf is provided that comprises white lines which may be used as floor of a sports field. The white fibers are mechanically fixed to the turf backing as strongly as the green turf fibers, as the white fibers comprise a separate nucleating agent in addition to the dye. White fibers previously were observed to detach earlier than green fibers from the backing. By combining the green fibers with white fibers that have been stretched in the presence of a nucleating agent, an artificial turf is provided whose white fibers are fixed to the backing as strongly as the green fibers.

According to embodiments, each artificial turf fiber incorporated in the artificial turf backing is created by a process comprising: extruding the polymer mixture into a monofilament; quenching the monofilament; reheating the monofilament; and stretching the reheated monofilament to form the monofilament into an artificial turf fiber. In case the polymer mixture comprises a nucleating agent and/or a dye acting as nucleating agent, during the stretching the nucleating agent boosts the creation of crystalline portions of the at least one polymer within the monofilament, wherein the boosting of the creation of the crystalline portions increases the surface roughness of the monofilament.

According to embodiments, each of the at least one monofilament comprises a first polymer in the form of threadlike regions and the at least one polymer referred herein as a "second polymer". The threadlike regions are embedded in the second polymer. The first polymer is immiscible in the second polymer. The polymer mixture further comprises a compatibilizer surrounding each of the threadlike regions and separating the at least one first polymer from the second polymer.

BRIEF DESCRIPTION OF THE DRAWINGS

In the following embodiments of the invention are explained in greater detail, by way of example only, making reference to the drawings in which.

DETAILED DESCRIPTION

Like numbered elements in these figures are either equivalent elements or perform the same function. Elements which have been discussed previously will not necessarily be discussed in later figures if the function is equivalent.

Figure 1:
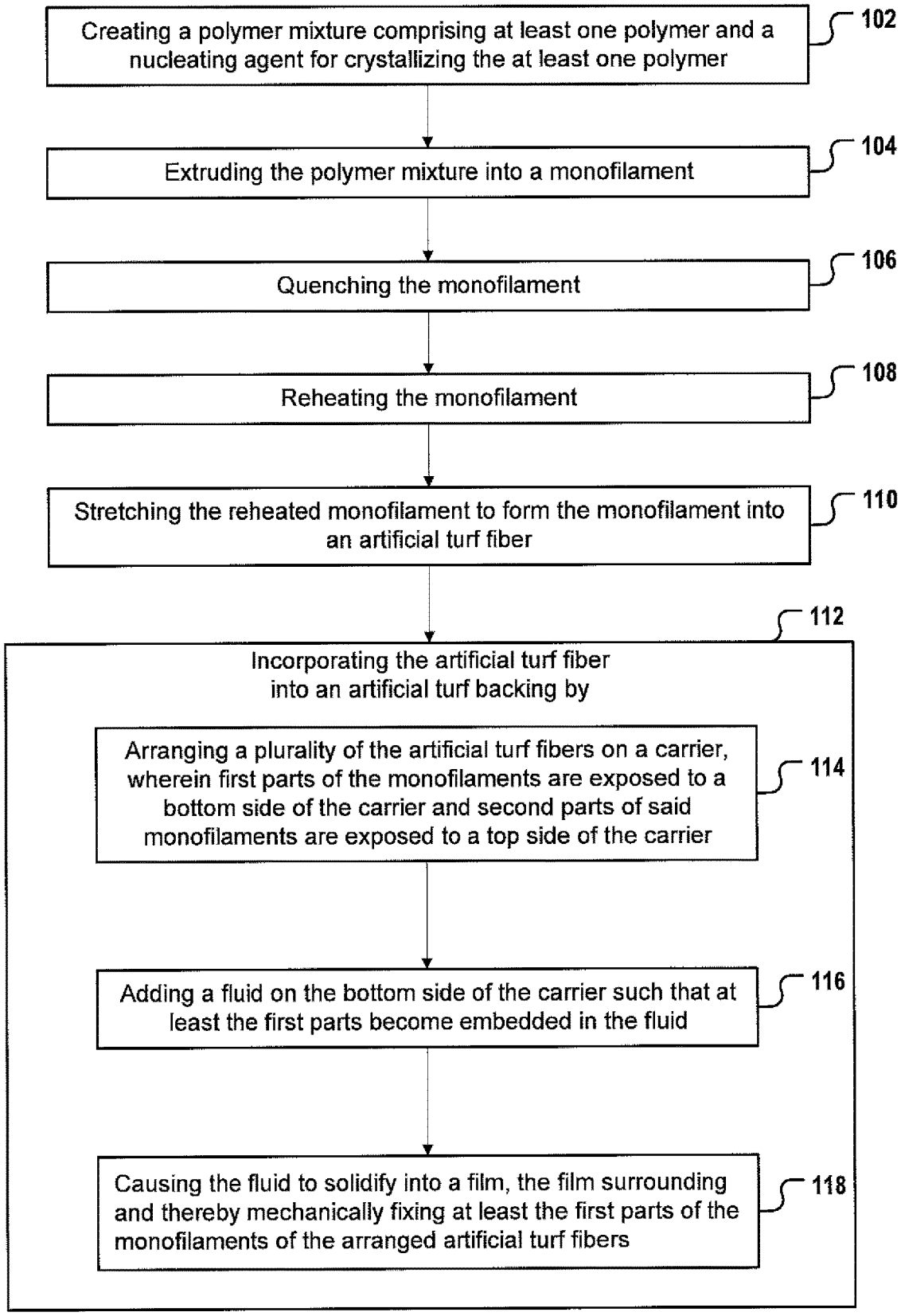
FIG. 1 shows a flowchart which illustrates an example of a method of manufacturing artificial turf.
Figure 2A:
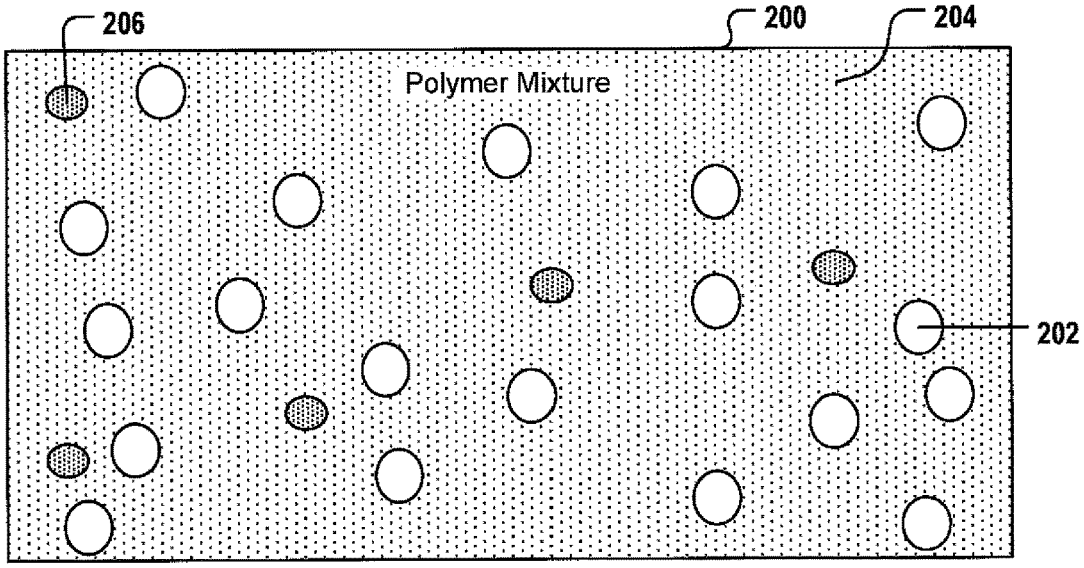
FIG. 2*a* shows a diagram which illustrates a cross-section of a polymer mixture.

FIG. 1 shows a flowchart which illustrates an example of a method of manufacturing artificial turf. First in step 102 a polymer mixture such as the mixture 200 depicted in FIG. 2*a* is created. The polymer mixture 200 comprises at least one polymer, typically polyethylene 204 and a nucleating agent 202, e.g. talcum of the above described scales ("nano scale talcum") for crystallizing the at least one polymer 204.

The polymer mixture may be created by putting all of the components that make it up together at once. For instance the at least one polymer 204, the nucleating agent 202 and the optional additives 206 and dyes 208 could be all added together at the same time. The polymer mixture could be thoroughly mixed for instance by using a mixer device. The desired distribution of the components can be achieved by using the proper rate or amount of mixing. The generated mixture could be forwarded to a one-screw feed or a two-screw feed for the extrusion.

Figure 2B:
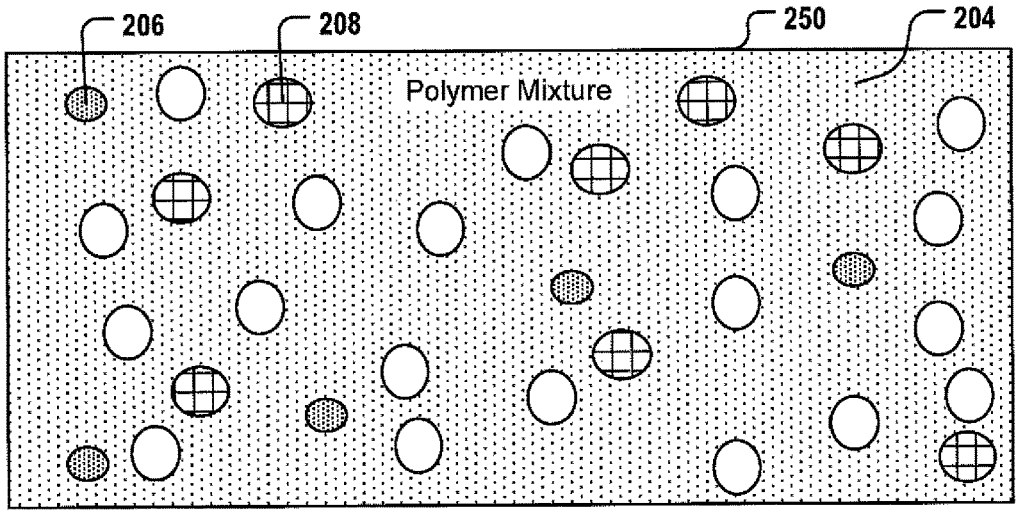
FIG. 2*b* shows a further example of a polymer mixture.
Figure 3A:
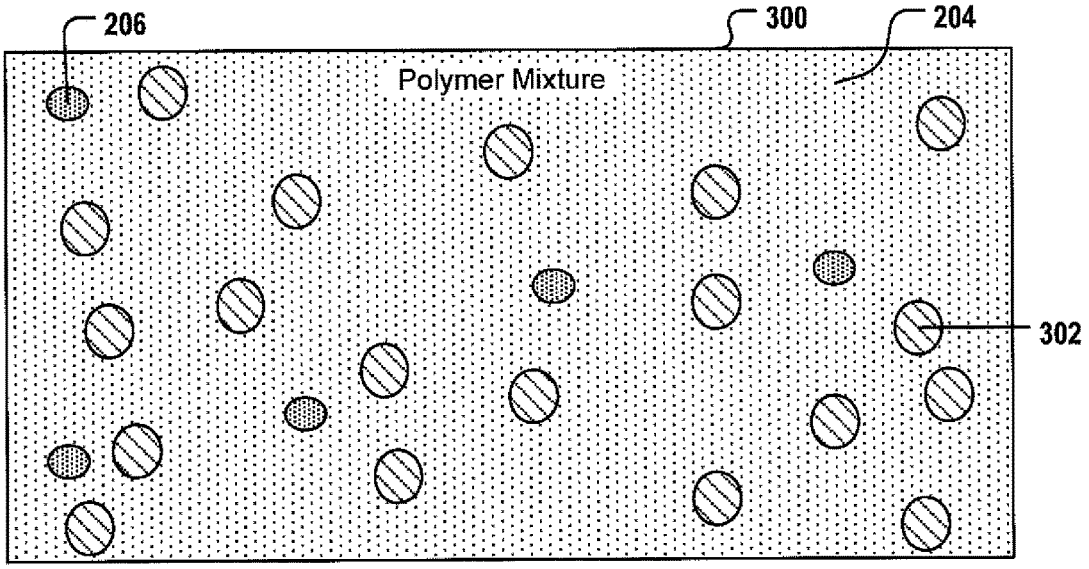
FIG. 3*a* shows a further example of a polymer mixture.
Figure 3B:
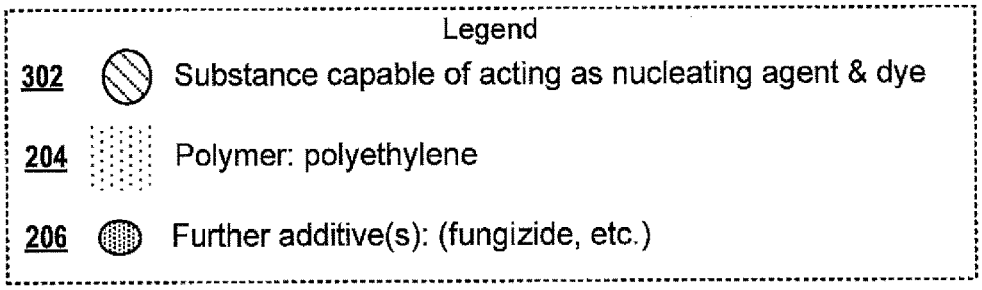
FIG. 3*b* is a legend for FIG. 3*a;*
Figure 4:
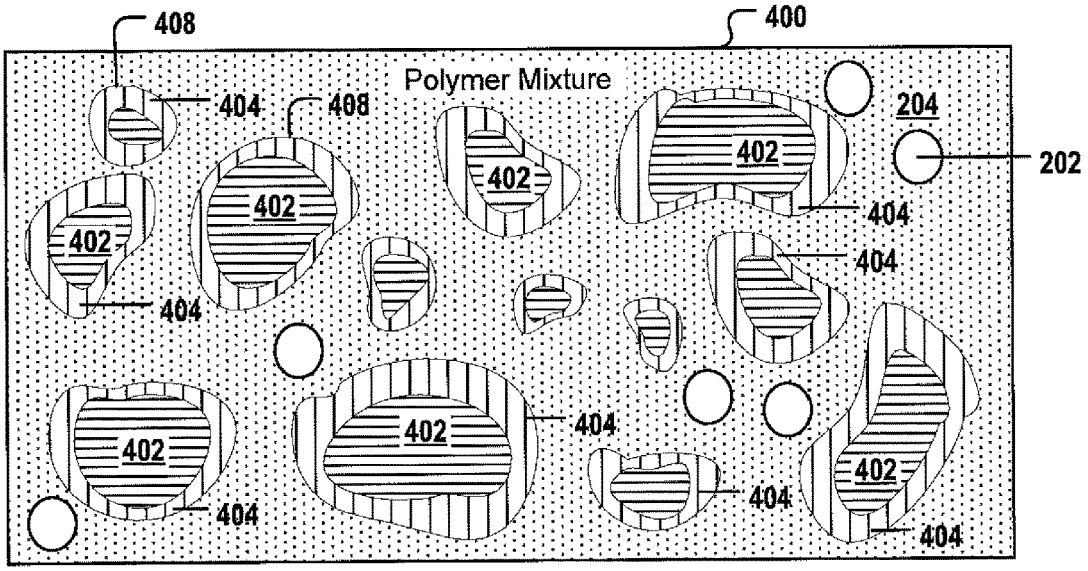
FIG. 4 shows a further example of a polymer mixture.

In other examples there may be additional substances, e.g. an additional dye, as depicted in FIG. 2*b*, or additional polymers such as in the polymer mixture 400 depicted in FIG. 4. Alternatively, a substance 302 may be used instead of talcum which acts as dye and as nucleating agent (see FIG. 3).

Figure 5:
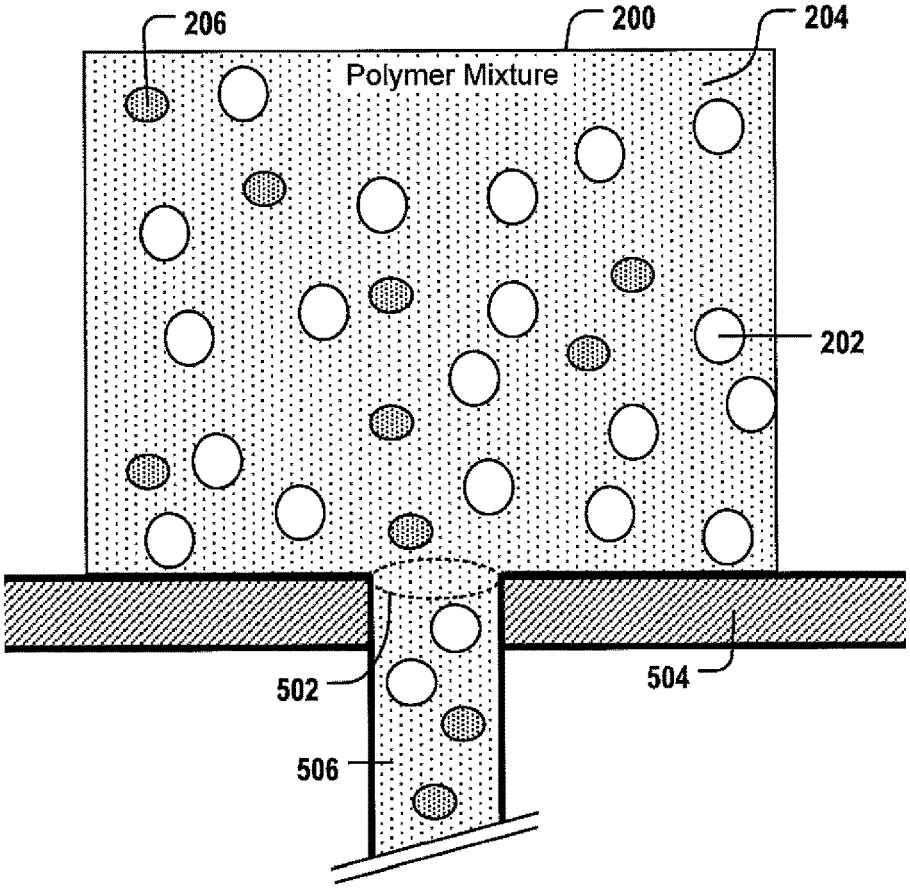
FIG. 5 illustrates the extrusion of the polymer mixture into a monofilament.

Next in step 104, the polymer mixture is extruded into a monofilament 506 as depicted in greater detail in FIG. 5. Next in step 106 the monofilament is quenched or rapidly cooled down. Next in step 108 the monofilament is reheated. In step 110 the reheated monofilament is stretched to form a monofilament that can directly be used as an artificial turf fiber or that can be bundled with additional monofilaments into an artificial turf fiber. Additional steps may also be performed on the monofilament to form the artificial turf fiber. For instance the monofilament may be spun or woven into a yarn with desired properties. Next in step 112 the artificial turf fiber is incorporated into an artificial turf backing. The incorporation comprises a step 114 of arranging a plurality of the artificial turf fibers on a carrier 704 (see FIGS. 7 and 8). The carrier may be a textile plane, for example. The artificial turf fibers are arranged such that first parts 706 of the monofilaments are exposed to a bottom side of the carrier and second parts 702 of said monofilaments are exposed to a top side of the carrier. The arranging could be accomplished by tufting or weaving the artificial turf fiber into the carrier, but other methods of arranging the fibers within the carrier are also possible.

Then in step 116 a fluid is added on the bottom side of the carrier such that at least the first parts become embedded in the fluid. Finally, in step 118, the fluid is caused to solidify into a film. The film surrounds and thereby mechanically fixes at least the first parts 706 (and optionally also some portions 804 of the second parts 702) of the monofilaments in the film. The film, i.e., the solidified fluid, constitutes the backing 802.

FIG. 2*a* shows a cross section of a polymer mixture 200 comprising at least a first polymer 204, preferentially a non-polar polymer such as polyethylene, and a nucleating agent 202 such as nanoscale talcum. The polymer mixture may comprise further additives such as fungicides or the like. The nucleating agent 202 boosts the creation of crystalline portions of polyethylene, in particular during the stretching step 110. The increased fraction of crystalline portions results in an increased surface roughness of the monofilaments and also eases the wettening of the monofilaments by the fluid used for embedding 116 at least the first parts of the monofilaments. In combination, said effects result in a strong mechanical fixing of the artificial turf fiber in the backing 802 and thus result in an increased resistance against wear and tear of the resulting artificial turf 800.

FIG. 2*b* shows a polymer mixture 250 comprising all the components of the mixture 200 of FIG. 2*a* and in addition a dye 208, e.g. titanium dioxide for white color or a azo-nickel-complex pigment for yellow color. Said dyes are not able to act as nucleating agent and are not capable of boosting the creation of crystalline portions of the polymer 204 to a sufficient degree. However, as the nucleating agent 202 is present in mixture 250, it is not necessary that the dye itself has any nucleating capabilities, and any kind of dye can be chosen freely and combined with each other.

Figure 2C:
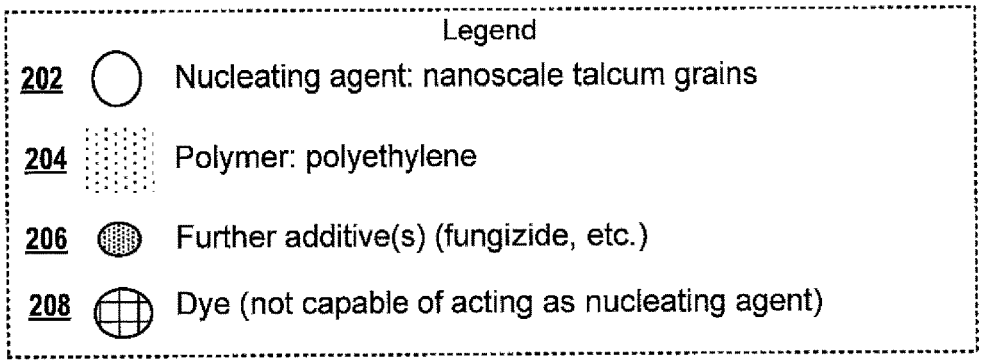
FIG. 2*c* is a legend for FIGS. 2*a* and 2*b;*

FIG. 2*c* is a legend for FIGS. 2*a* and 2*b*.

FIG. 3*a* shows a cross section of a polymer mixture 300 comprising at least a first polymer 204 such as polyethylene, and a nucleating agent 302 such as phthalocyanine green, which in addition acts as a dye for generating artificial turf fibers of green color. Alternatively, or in addition, the substance 302 may consist of phthalocyanine blue, which acts as a nucleating agent and as a dye for generating artificial turf fibers of blue color. Using dyes which are capable of acting as a dye may be advantageous as the amount of nucleating agent may be reduced without reducing the strength of the mechanical fixing of the fiber in the turf backing 802.

In case the desired color consists of a mixture of two or more dyes of different color, it is possible to combine a dye 208 being incapable of acting as a nucleating agent (e.g. azo-nickel-complex pigment providing yellow color) with another dye 302 capable of acting as nucleating agent (e.g. phthalocyanine blue) in order to provide the desired color, e.g. green, without adding additional nucleating agents such as talcum or sorbic acid. This eases the process of manufacturing the artificial turf. FIG. 3*b* is a legend for FIG. 3*a*.

FIG. 4 shows a diagram which illustrates a cross-section of a polymer mixture 400. The polymer mixture 400 comprises a first polymer 402 and the above mentioned at least one polymer which is referred to in this section as "second polymer" 204. The second polymer may be, for example, ethylene. The mixture 400 further comprises a compatibilizer 404 and a nucleating agent 202. The first polymer 402 and the second polymer 204 are immiscible. The first polymer 402 is less abundant than the second polymer 204. The first polymer 402 is shown as being surrounded by compatibilizer 404 and being dispersed within the second polymer 204. The first polymer 402 surrounded by the compatibilizer 404 forms a number of polymer beads 408. The polymer beads 408 may be spherical or oval in shape or they may also be irregularly-shaped depending up on how well the polymer mixture is mixed and the temperature. The polymer mixture 400 is an example of a three-phase system. The three phases are the regions of the first polymer 402. The second phase region is the compatibilizer 404 and the third phase region is the second polymer 204. The compatibilizer 404 separates the first polymer 402 from the second polymer 204.

The mixture 400 may in addition comprise polymers such as a third, fourth, or even fifth polymers that are also immiscible with the second polymer. There also may be additional compatibilizers which are used either in combination with the first polymer or the additional third, fourth, or fifth polymer. The first polymer forms polymer beads 408 surrounded by the compatibilizer. The polymer beads may also be formed by additional polymers which are not miscible in the second polymer. The polymer beads are surrounded by the compatibilizer and are within the second polymer or mixed into the second polymer.

A first mixture is formed by mixing the first polymer with the compatibilizer. Additional additives may also be added during this step. Then the first mixture is heated and the heated first mixture is extruded. Then the extruded first mixture is granulated or chopped into small pieces. The granulated first mixture is mixed with the second polymer. Additional additives may also be added to the polymer mixture at this time. Finally the granulated first mixture is heated with the second polymer and a nucleating agent to form the polymer mixture. The heating and mixing may occur at the same time.

FIG. 5 illustrates the extrusion of the polymer mixture into a monofilament 506. Shown is an amount of polymer mixture 200. Within the polymer mixture 200 there is a large number of nucleating agents 202 and optionally also additional substances 206 such as UV-stabilizers or the like. A screw, piston or other device is used to force the polymer mixture 200 through a hole 502 in a plate 504. This causes the polymer mixture 200 to be extruded into a monofilament 506. The monofilament 506 is shown as containing the nucleating agent 202 and the additives 206 also.

In the case of extruding polymer mixture 400 (not shown), the second polymer 204 and the polymer beads 408 would be extruded together. In some examples the second polymer 204 will be less viscous than the polymer beads 408 and the polymer beads 408 will tend to concentrate in the center of the monofilament 506. This may lead to desirable properties for the final artificial turf fiber as this may lead to a concentration of the thread-like regions in the core region of the monofilament 506.

Figure 6:
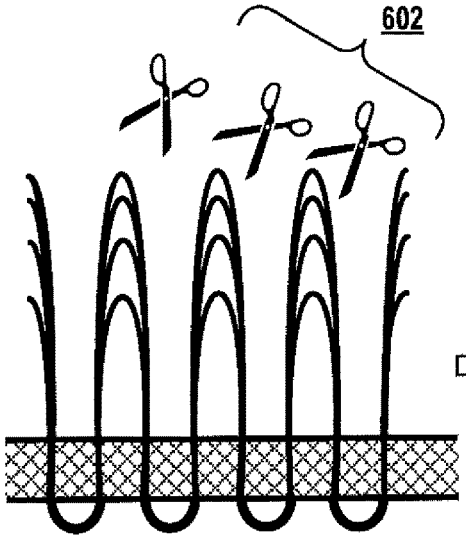
FIG. 6 shows the tufting of an artificial turf fiber.
Figure 7:
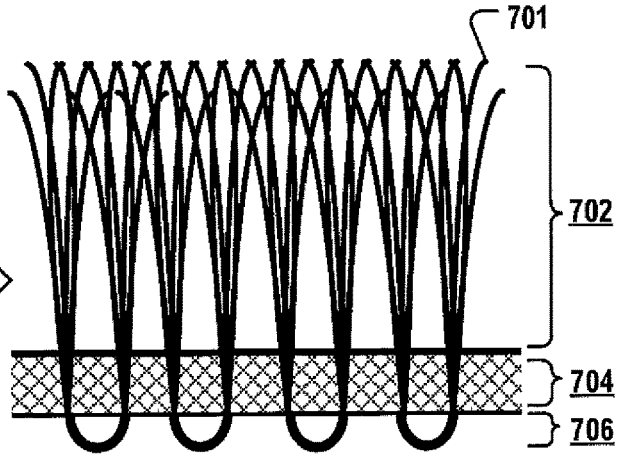
FIG. 7 illustrates first and second parts of the fiber.

FIGS. 6 and 7 show how a plurality of artificial turf fibers can be arranged in a carrier 704, e.g. a textile plane, by means of tufting. Tufting is a type of textile weaving in which an artificial turf fiber 701 (that may be a monofilament 506 or a bundle of multiple monofilaments) is inserted on a carrier 704. After the inserting is done, as depicted in FIG. 6, short U-shaped loops of the fiber point outside of the carrier's surface. Then, one or more blades cut 602 through the loops. As a result of the cutting step, two artificial turf fiber ends per loop and monofilament point out from the carrier and a grass-like artificial turf surface is generated. Thereby, first parts 706 of the monofilaments of the artificial turf fibers having been inserted in the carrier 704 are exposed to a bottom side of the carrier and second parts 702 of said monofilaments are exposed to a top side of the carrier.

Figure 8A:
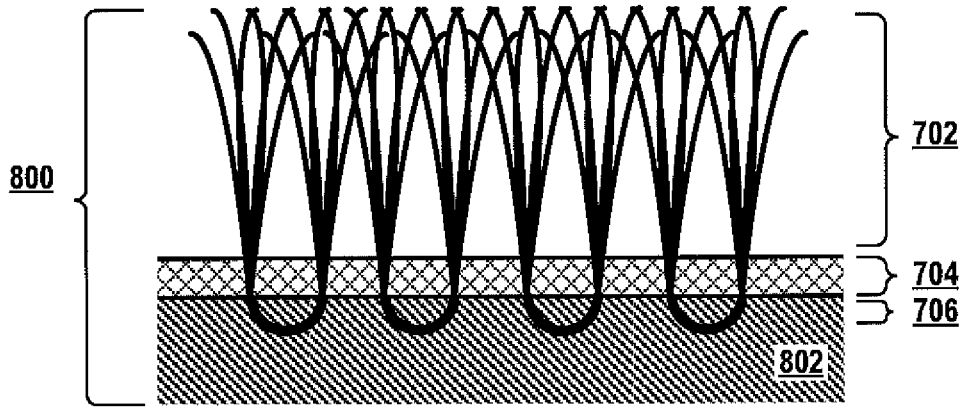
FIG. 8 shows the first parts and portions of second parts of the fibers embedded in the turf backing.
Figure 8B:
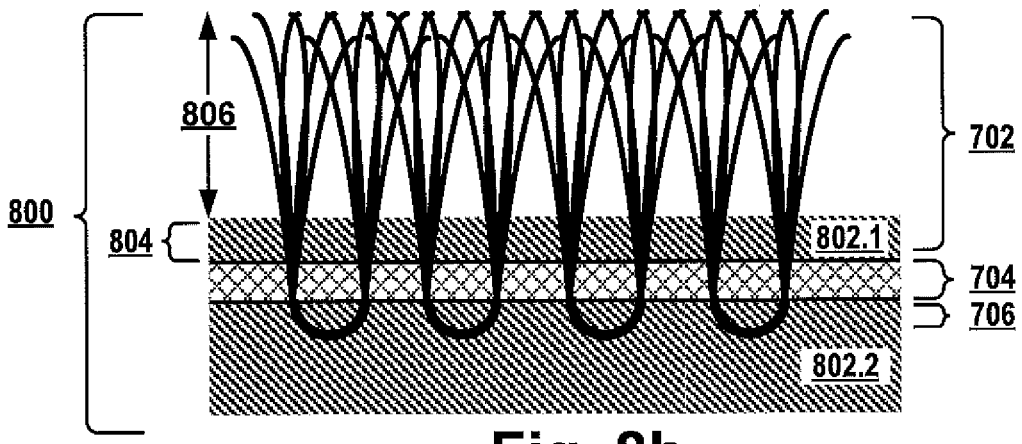

FIG. 8 depicts the carrier 704 with the inserted filaments having been embedded within (FIG. 8*a*) or next to a surface of (FIG. 8*b*) an artificial turf backing 802. This is performed by adding a fluid in step 116 (see FIG. 1) on the carrier 704 such that the first parts 706 of the monofilaments become embedded in the fluid (FIG. 8*a*) or the first parts and some portions 804 of the second parts 702 of the monofilaments (FIG. 8*b*) become embedded in the fluid. The carrier may be a textile mesh or may comprise perforations that allow the fluid 802.2 at the bottom side of the carrier to flow to the upper side of the carrier and vice versa, thereby creating a portion 802.1 of the backing on top of the carrier. Thus, the carrier and parts of the fibers inserted in the carrier may become embedded in the backing 802. The artificial turf fibers 701 are shown as extending a distance 806 above the carrier 704. The distance 806 is essentially the height of the pile of the artificial turf fibers 701.

The fluid may be a styrene-butadiene suspension that solidifies into a latex backing or may be a mixture of polyols and polyisocyanates that solidifies into a polyurethane backing or any other kind of fluid that is capable of solidifying after a defined time period into a solid film. The fluid solidifies into a film 802, e.g. by a drying process or by a chemical reaction resulting in a solidification of the fluid. Such a chemical reaction can be, for example, a polymerization. The film surrounds and thereby mechanically fixes at least the first parts of the monofilaments of the arranged artificial turf fibers. The solid film acts as the artificial turf backing. In some examples, additional coating layers may be added on the bottom of the artificial turf backing.

LIST OF REFERENCE NUMERALS

102-118 steps
200 put in the mixture
202 nucleating agent
204 polyethylene
206 further additive substances
208 dye
300 polymer mixture
302 substance acting as a nucleating agent
400 polymer mixture
402 first polymer, polyamide
404 compatibilizer
408 polymer bead
502 hole in a plate
504 plate
506 monofilament of artificial turf fiber
602 cutting artificial turf fibers during tufting
701 individual artificial turf fiber
702 second parts of fibers
704 carrier
706 first parts of fibers first parts of fiber
800 artificial turf (cross-section)
802 backing made from solidified fluid
804 portions of the second parts of the fibers embedded in the fluid
806 distance <carrier-surface-upper ends of fibers>

The invention claimed is:

1. An artificial turf, comprising:

a carrier comprising a bottom side, a top side and perforations;

an artificial turf backing formed on the bottom side of the carrier, in the perforations of the carrier and on the top side of the carrier; and a plurality of artificial turf fibers fixed to the artificial turf backing such that first parts of the artificial turf fibers are mechanically fixed at the bottom side of the carrier and some portions of second parts of the artificial turf fibers are mechanically fixed at the top side of the carrier, wherein each artificial turf fiber is formed by a process comprising:

creating a polymer mixture comprising at least one polymer and a nucleating agent for crystallizing the at least one polymer, the nucleating agent being a mixture of an inorganic substance and an organic substance, wherein the polymer mixture comprises 0.2% to 0.4% by weight the inorganic substance;

extruding the polymer mixture into a monofilament;

quenching the monofilament;

reheating the monofilament; and stretching the reheated monofilament to form the monofilament into each artificial turf fiber, wherein during the stretching the nucleating agent boosts the creation of crystalline portions of the at least one polymer within the monofilament as compared to crystalline portions that would be created from stretching the reheated monofilament extruded from the polymer mixture without the nucleating agent, and wherein the boosting of the creation of the crystalline portions increases a surface roughness of the monofilament.

2. A method of manufacturing artificial turf that is durable to mechanical stress, the method comprising:

creating a polymer mixture comprising at least one polymer and a nucleating agent for crystallizing the at least one polymer, the nucleating agent being a mixture of an inorganic substance and an organic substance, wherein the polymer mixture comprises 0.2% to 0.4% by weight the inorganic substance;

wherein the inorganic substance acting as the nucleating agent consists of one or more of: talcum; kaolin; calcium carbonate; magnesium carbonate; silicate; silicic acid; silicic acid ester; aluminium trihydrate; magnesium hydroxide; meta- and/or polyphosphates; and coal fly ash;

wherein the organic substance acting as the nucleating agent consists of one or more of: 1,2-cyclohexane dicarbonic acid salt; benzoic acid; benzoic acid salt; sorbic acid; or sorbic acid salt;

extruding the polymer mixture into a monofilament;

quenching the monofilament;

reheating the monofilament;

stretching the reheated monofilament to form the monofilament into an artificial turf fiber, wherein during the stretching the nucleating agent boosts the creation of crystalline portions of the at least one polymer within the monofilament as compared to crystalline portions that would be created from stretching the reheated monofilament extruded from the polymer mixture without the nucleating agent, wherein the boosting of the creation of the crystalline portions increases a surface roughness of the monofilament;

incorporating the artificial turf fiber into an artificial turf backing by arranging a plurality of the artificial turf fibers on a carrier having perforations, wherein first parts of the monofilaments of the arranged artificial turf fibers are exposed to a bottom side of the carrier and second parts of said monofilaments are exposed to a top side of the carrier;

adding a fluid on the bottom side of the carrier such that at least the first parts and some portions of the second parts of the monofilaments become embedded in the fluid, wherein the perforations are configured to allow the fluid on the bottom side of the carrier to flow to the top side of the carrier; and causing the fluid to solidify into a film, the film surrounding and thereby mechanically fixing at least the first parts and the some portions of the second parts of the monofilaments of the arranged artificial turf fibers, the solid film acting as the artificial turf backing.

3. The method of claim 2, wherein the at least one polymer comprises crystalline portions and amorphous portions, wherein the presence of the nucleating agent in the polymer mixture during the stretching causes an increase in the size of the crystalline portions relative to the amorphous portions.

4. The method of claim 2, wherein some or all parts of the surface of the artificial turf fiber embedded in the fluid are wetted by the fluid.

5. The method of claim 2, wherein the fluid is a suspension comprising at least 20 percent by weight styrene-butadiene, at least 40% of chemically inert filler material, and at least 15% dispersion fluid;

wherein the solidification of the fluid into the film comprises drying the suspension.

6. The method of claim 5, wherein the suspension comprises 22-28 percent by weight of the styrene-butadiene, 50-55 percent by weight of the filler material, and at least 20% of water acting as the dispersion fluid.

7. The method of claim 2, wherein the fluid is a mixture of polyols and polyisocyanates, the polyols being compounds with multiple hydroxyl functional groups available for organic reactions;

wherein the solidification of the fluid into the film comprises executing a polyaddition-reaction of the polyols and the polyisocyanates for generating polyurethane, the solid film being a polyurethane film.

8. The method of claim 2, wherein the at least one polymer is any one of the following: polyethylene, polypropylene, or a mixture thereof.

9. The method of claim 2, wherein creating the artificial turf fiber comprises:

forming the stretched monofilament into a yam; or weaving, spinning, twisting, rewinding, and/or bundling the stretched monofilament into the artificial turf fiber.

10. The method of claim 2, wherein incorporating the artificial turf fiber into the artificial turf backing comprises one of:

weaving the artificial turf fiber into the artificial turf backing; or tufting the artificial turf fiber into the artificial turf backing and binding the artificial turf fibers to the artificial turf backing.

11. The method of claim 2, wherein the polymer mixture is at least a three-phase system, wherein the polymer mixture comprises a first polymer, the at least one polymer as second polymer, and a compatibilizer, wherein the first polymer and the second polymer are immiscible, wherein the first polymer forms polymer beads surrounded by the compatibilizer within the second polymer;

wherein the method further comprises adding a first dye before the extruding; and wherein the stretching results in a deformation of the polymer beads into threadlike shaped regions.

* * * * *